United States Patent [19]

Fletcher

[11] 4,422,642

[45] Dec. 27, 1983

[54] NOVELTY EDUCATIONAL PUZZLE APPARATUS

[76] Inventor: Leslie S. Fletcher, 4230 Yorkshire La., Northbrook, Ill. 60062

[21] Appl. No.: 429,327

[22] Filed: Sep. 30, 1982

[51] Int. Cl.[3] ..... A63F 9/10; G09B 1/36; G09B 1/38

[52] U.S. Cl. ..... 273/157 R; 434/170; 434/171; 434/207; 434/406

[58] Field of Search ..... 273/157 R; 434/171, 434/172, 170, 191, 207, 406, 177

[56] References Cited

U.S. PATENT DOCUMENTS

| | | | |
|---|---|---|---|
| 1,477,322 | 12/1923 | Degheri | 434/406 |
| 1,604,127 | 10/1926 | Lambert | 434/177 |
| 2,513,596 | 7/1950 | Severson | 434/208 |
| 2,875,531 | 3/1959 | Mansfield | 434/406 |
| 3,290,798 | 12/1966 | Gilbert | 434/191 |
| 3,302,310 | 2/1967 | Leven | 434/171 |
| 4,044,476 | 8/1977 | Marsh | 434/171 |
| 4,076,253 | 2/1978 | Eriksen | 273/157 R |
| 4,360,347 | 11/1982 | Ghaznavi | 273/157 R X |
| 4,361,328 | 11/1982 | Stein et al. | 434/406 X |

*Primary Examiner*—William H. Grieb
*Attorney, Agent, or Firm*—Dick and Harris

[57] ABSTRACT

A novelty educational puzzle for instructing users in multidirectional, mathematical and grammatical skills that is restrictive as to both the answers and problems in both the vertical and horizontal directions as well as being color coded to further aid the user and facilitate proper assembly and simultaneous solution to the problems thereon.

9 Claims, 3 Drawing Figures

NOVELTY EDUCATIONAL PUZZLE APPARATUS

BACKGROUND OF THE INVENTION

The present invention relates in general to novelty educational devices for children and particularly to an interlocking novelty educational puzzle apparatus.

While a myriad of novelty educational devices have been developed over the years, several of which involve "puzzle"-type configurations such as those disclosed by U.S. Pat. Nos. 1,604,127; 1,477,322; and 3,290,798; few, if any, of such devices address a novelty puzzle apparatus for use in a mathematical or alphabetical presentation which is both physically and design restrictive in both the horizontal and vertical directions. Such a double-restrictive puzzle capable of manifesting a "problem" for solution along both of two dimensions can greatly benefit young children or even adults with mild retardation or learning disabilities, while providing yet additional puzzle "clues" to prompt the user to the only correct solution.

Clearly, such visual devices can greatly aid in teaching mathematical, reading or art skills. Hence, the present invention has as an object the display of mathematical equations or spelling exercises when fully assembled.

The present invention also has as an object the use of a plurality of restrictive features that enable assembly of the puzzle only when correct problems and correct answers are appropriately arranged.

A further object of the present invention is to provide numerical and alphabetical "equations" in both the vertical direction and the horizontal direction so as to enable the user to work with a maximum number of educational exercises which simultaneously control the overall construction so as to provide a puzzle that is restrictive as to both problems and answers in both the vertical and horizontal directions.

Another object of the present invention is to provide color coding of the vertical columns of numbers or letters so as to provide yet another clue to the user as to correct solutions of the equations displayed on the puzzle, while at the same time teaching color combinations.

An additional object of the present invention is to provide numerical or alphabetic equations that provide clues to both the elements of certain colors and the result of their combination.

Yet another object of the present invention is to provide a puzzle apparatus that requires a minimum amount of prior familiarity with the techniques needed to solve it, so as to allow users of all ages or intelligence levels to use it by relying upon a plurality of physical and design restrictions for solution thereof.

These and other objects of the invention will become apparent in light of the present specification and drawings.

SUMMARY OF THE INVENTION

The present invention comprises a novelty educational puzzle for instructing users in multidirectional, grammatical, mathematical and/or color skills through the utilization of a plurality of interlocking puzzle pieces. Written information in the form of word portions or numerals is provided on the pieces in the form of problems and answers which can be properly combined in both the horizontal and vertical directions. In addition, the puzzle pieces are capable of interlocking in both the vertical and horizontal directions in only one correct arrangement pattern.

Assembly of the puzzle is restricted to a sequence that correctly solves the problems and answers of the puzzle. The previously mentioned equations and answers are aligned both vertically and horizontally. The restrictive nature of the puzzle pieces provides a puzzle that is restrictive in nature to ensure correct assembly as to both the problems and answer portions in both the vertical and horizontal directions.

Specifically, cooperating tabs and recesses along the edges of the puzzle pieces serve to physically restrict assembly, in the manner described above. In the embodiments described, operation indicators are located near the tabs and recesses. Further, either the columns or rows of symbols can be of different colors so as to provide a further clue as to proper assembly and the solutions of the answers pictured thereon. In such an embodiment yet a third item of education is manifested since the colors being so combined, in fact, would combine in color theory to form the resultant color shown.

In this "color" embodiment, the previously mentioned information displayed in the form of equations may be either numerical or alphabetic, consisting of word portions.

DETAILED DESCRIPTION OF THE DRAWINGS

Figure 1:
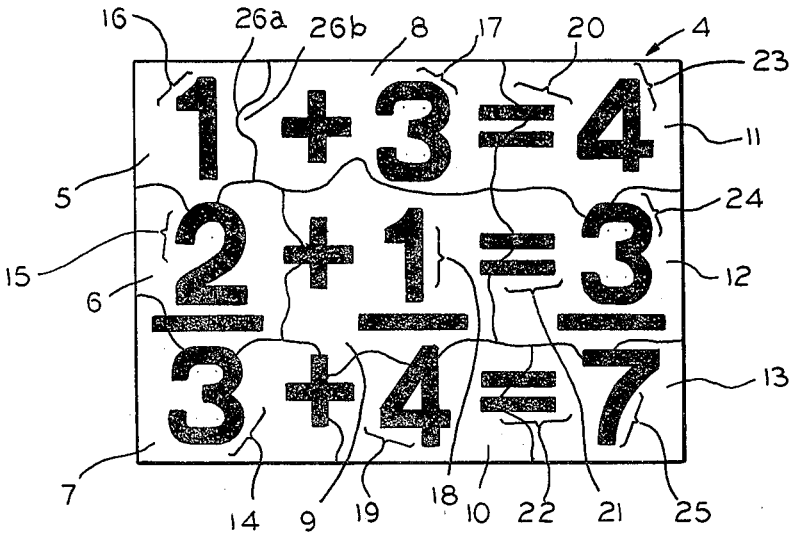
FIG. 1 is a top planar view of the mathematical equation embodiment of the novelty educational puzzle apparatus in the assembled or interlocked mode showing particularly the plurality of puzzle pieces, the cooperating tabs and recesses along the edges thereof, and the rows and columns of numerals thereon forming equations consisting of problems and answers both vertically and horizontally.

While this invention is susceptible of embodiment in many forms, there are shown in the drawings and will herein be described in detail several specific embodiments, with the understanding that the present disclosure is to be considered an exemplification of the principles of the invention and is not intended to limit the invention to the embodiments illustrated.

Novelty educational puzzle apparatus 4 is shown in top view in FIG. 1. As shown, puzzle pieces 5 through 13 are interlockable as a result of cooperating tabs and recesses, such as recess *26a* and tab *26b* formed about the edges of puzzle pieces 5 through 13. Numerical symbols 14 through 19 and 23 through 25 are arranged in horizontal rows and vertical columns so as to form the illustrated mathematical problems and solutions, in both the vertical and horizontal directions.

Cooperating tabs and recesses such as recess 26b and tab 26a respectively, serve to restrict assembly of puzzle apparatus 4, to only the correct alignment of both the problem portions and solution portions in both the vertical and horizontal directions. Further, operation indicators 20, 21 and 22 are located upon respective ones of cooperating tabs and recesses. This allows physically restrictive assembly of the problem portions and the correct answers to the particular problem thereby permitting simultaneous completion of the puzzle 4 as well as correct completion of the equations contained thereon.

Figure 2:
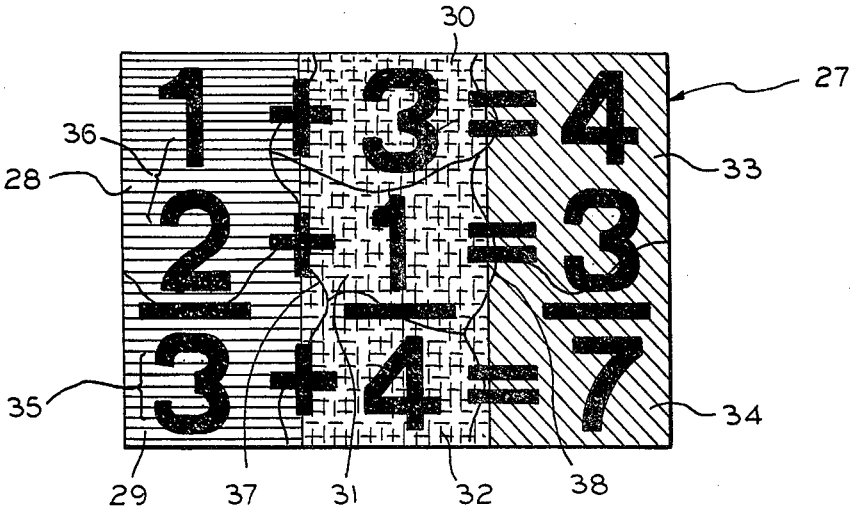
FIG. 2 is a top planar view of the color coded mathematical equation embodiment of the novelty educational puzzle apparatus in the assembled or interlocked mode showing in particular the utilization of vertical column color coding.

The color coded embodiment of puzzle 27 is illustrated in FIG. 2. As with embodiment 4, puzzle pieces 28, 30 and 33; 28, 31 and 33; and 29, 32 and 34 form numerical equations and solutions in the horizontal direction. In the vertical direction, puzzle pieces 28 and 29; 30, 31 and 32; and 33 and 34 form the equations and solutions. The previously described cooperating tabs and recesses result in a puzzle that is restrictive to both problems and answers both vertically and horizontally.

Specifically in the color coded embodiment of puzzle 27, the three vertical columns are each of a different color such as the blue portion made up by pieces 28 and 29, the yellow portion made up by pieces 30 through 32, and the "resultant" green portion made up by puzzle pieces 33 and 34. Hence, a clue is provided to the user of the puzzle, as to the correct sequence of assembly. In this case, assembly of the yellow vertical column requires matching of tabs on puzzle piece 30 with corresponding recesses of puzzle piece 31, both of which are of the same color, so as to complete the vertical problem portion resulting in the answer of piece 32. The proper solution to the problem shown in the yellow column can then be confirmed by the fact that only when properly solved will the entire column pieces all be of the same color. Conversely, the above-described color coding can serve to aid the user in finding the proper problem combination, such as that shown by pieces 30 and 31 corresponding to an answer portion piece 32. Further, the puzzle pieces such as 28, 30 and 33 also contain a minimal portion of the color of the next proximate column on at least one of their protruding tabs such as tab 37 so as to thereby provide a clue as to proper assembly in the perpendicular direction, in this case the horizontal.

As further shown in FIG. 2, the colors of the three vertical columns shown change proximate the operation indicators here either plus or equal signs. In addition, yet another clue is provided to the user as to the proper assembly sequence of puzzle 27 since the color of the first column of numerals (pieces 28 through 29) blue, when added to the color of second column of numerals (pieces 30 through 31) yellow, results in the color of resultant third column of numerals (pieces 33 and 34) green. Hence, not only can the color sequence aid in learning the mathematics problems 36 and answers 35 appearing upon puzzle 27, but conversely, the problems 36 and answers 35 thereon can aid in learning the results of combinations of components of common colors. It must be noted, however, that although the embodiment pictured in FIG. 2 shows the color variations of columns 72, 73 and 74 along the horizontal direction, the scope of the present invention includes the embodiment wherein the colors vary along the vertical direction along the rows of numerals. Such a horizontally oriented color coding embodiment would operate in a similar manner. Similarly, the colors can vary along both the horizontal and vertical direction simultaneously.

Figure 3:
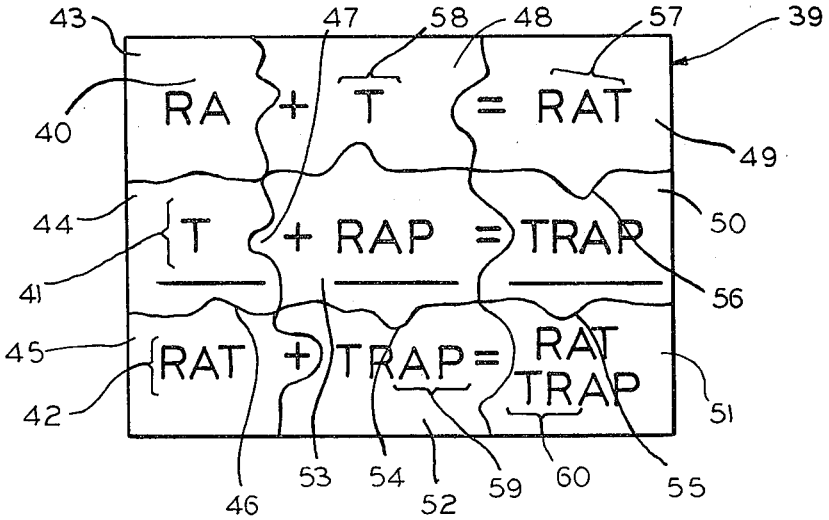
FIG. 3 is a top planar view of the alphabetic equation embodiment of the novelty educational puzzle apparatus in the assembled or interlocked mode showing in particular the plurality of puzzle pieces; the cooperating tabs and recesses along the edges thereof; and the rows and columns of letters thereon forming words consisting of spelling problems and answers in both the vertical and horizontal directions.

An alphabetic equation embodiment 39 of the novelty educational puzzle apparatus is illustrated in FIG. 3. As shown, when assembled by mating the corresponding tabs such as 47 and recesses such as recess 46 on the puzzle pieces, puzzle pieces 43–45 and 48–53 set forth "equations" consisting of word portions such as 40, 58 and 57 in the horizontal direction and word portions 40, 41 and 42 in the vertical direction.

Specifically, puzzle pieces 44, 53 and 50; and 45, 52 and 51 also form alphabetic "equations" in the horizontal direction which are restricted by correspondingly shaped tabs and recesses so as to be capable of being assembled only in the proper sequence both with respect to the problem portion and the answer portion. Similarly, puzzle pieces 43, 44 and 45; 53 and 52; and 49, 50 and 51 form alphabetic equations in the vertical directions as a result of the word portions and operation indicators formed thereon. Both the problem portions and answer portions are similarly restricted in the vertical direction as well. As shown, word 42 added to word 59 results in words 60. Similarly, in the vertical direction word portion 40 added to portion 41 results in word 42 while in the horizontal direction word portion 40 added to portion 58 results in word 57.

In puzzle apparatus 39 shown in FIG. 3, operation indicators such as the plus and equal signs are situated proximate the edges of puzzle pieces such as puzzle pieces 45 and 51. Furthermore, it must be noted that the scope of the invention includes color coding of the alphabetic embodiment 39, as was described previously for the mathematical embodiment of apparatus 27. In addition, with respect to puzzle apparata 4, 27 and 39, it must be noted that a puzzle piece may consist of either only a single numeral or word portion such as piece 5 of FIG. 1 or piece 43 of FIG. 3, or it may consist of an entire problem portion such as piece 28 of FIG. 2.

The foregoing description of the drawing merely explains and illustrates the invention, the invention is not limited thereto, except insofar as the appended claims are so limited, as those skilled in the art who have the disclosure before them will be able to make modifications and variations therein without departing from the spirit and scope of the invention.

What is claimed is:

1. A novelty educational puzzle for instructing users in multidirectional, mathematical, grammatical and color skills, said apparatus comprising:

a plurality of interlocking yet detachable puzzle piece means;

indicia means comprising written information situated upon said plurality of interlocking puzzle piece means;

said puzzle pieces being capable of interlocking with others of said plurality of puzzle pieces in both horizontal and vertical columns respectively;

assembly restriction means operably associated with said puzzle piece means so as to allow assembly of said puzzle piece means in both the vertical and horizontal directions only when said indicia means is in proper sequence;

said indicia means providing information in both the vertical and horizontal directions;

said indicia means information comprising initial information, and resultant information proximate to two edges of said puzzle; and said indicia means, said interlocking puzzle piece means, and said assembly restriction means cooperating to provide a puzzle that is restrictive in formation to ensure correct assembly as to both intermediate information and end information in both the vertical and horizontal directions.

2. The invention according to claim 1 wherein:

said assembly restriction means comprises a plurality of cooperating tabs and recesses situated along the corresponding edges of said puzzle pieces.

3. The novelty educational puzzle according to claim 1 wherein the invention further comprises:

operation indicators situated proximate to said cooperating tabs and recesses.

4. The invention according to claim 2 wherein:

portions of said puzzle piece means are of a particular color to describe a particular color along a vertical direction so as to indicate proper assembly of said puzzle pieces in said vertical direction.

5. The invention according to claim 4 wherein:

said color means along said vertical direction is distributed along each vertical column containing initial information and said vertical column containing resultant information to describe a color in said resultant information column which corresponds to the color combination of the colors contained in said initial information columns.

6. The invention according to claim 1 wherein:

portions of said puzzle piece means are of a particular color to describe a particular color sequence along a horizontal direction so as to indicate proper assembly of said puzzle pieces in said horizontal direction.

7. The invention according to claim 6 wherein:

said color means along said horizontal direction is distributed along each horizontal row containing initial information and said horizontal row containing resultant information to describe a color in said resultant information row which corresponds to the color combination of the colors contained in said initial information rows.

8. The invention according to claim 1 wherein said information on said indicia means comprises:

a plurality of numerical equations consisting of numbers arranged in both said horizontal rows and vertical columns and comprising problems and answers both vertically and horizontally acting in combination with said assembly restriction means so as to provide a puzzle that is restrictive as to problems and answers both vertically and horizontally; and each of said vertical columns and horizontal rows forming an equation.

9. The invention according to claim 1 wherein said information on said indicia means comprises:

a plurality of alphabetic equations consisting of word portions arranged in rows both said horizontal rows and vertical columns and comprising problems and answers both vertically and horizontally acting in combination with said assembly restriction means so as to provide a puzzle that is restrictive as to both answers and problems; and each of said horizontal rows and vertical columns forming an alphabetic equation with said resultant information being in the form of one or more words.

* * * * *